United States Patent [19]

Krabec et al.

[11] Patent Number: 4,477,693

[45] Date of Patent: Oct. 16, 1984

[54] MULTIPLY SHIELDED COAXIAL CABLE WITH VERY LOW TRANSFER IMPEDANCE

[75] Inventors: James A. Krabec, Chicago; John W. Kincaid, Batavia, both of Ill.; Paul B. Miller, Richmond, Ind.

[73] Assignee: Cooper Industries, Inc., Houston, Tex.

[21] Appl. No.: 448,219

[22] Filed: Dec. 9, 1982

[51] Int. Cl.[3] ..... H01B 11/06

[52] U.S. Cl. ..... 174/36; 174/105 R; 174/106 R; 174/107

[58] Field of Search ..... 174/105 R, 106 R, 107, 174/36

[56] References Cited

U.S. PATENT DOCUMENTS

| | | | |
|---|---|---|---|
| 3,321,572 | 5/1967 | Garner | 174/107 |
| 3,484,532 | 12/1969 | Anderson | 174/105 R |
| 3,643,007 | 2/1972 | Roberts et al. | 174/106 R |
| 3,681,515 | 8/1972 | Mildner | 174/105 R X |
| 3,927,247 | 12/1975 | Timmons | 174/107 X |
| 3,963,854 | 6/1976 | Fowler | 174/106 R X |
| 3,971,879 | 7/1976 | Rosenberg et al. | 174/36 |
| 4,117,260 | 9/1978 | Wilkenloh | 174/106 R |
| 4,327,246 | 4/1982 | Kincaid | 174/107 X |

OTHER PUBLICATIONS

Buchsbaum, Walter H.; Shielded Cables; Electronic World; vol. 72, No. 5; Nov. 1964; pp. 36–38, 111, 112.

Smith, Kenneth L., "RF, Leakage Test for CATV Drop Cable Gives Absolute Results," TV Communications, Dec. 1, 1978, pp. 114–116.

Belden Catalog, CATV Coaxial Cables, 1979.

*Primary Examiner*—John Gonzales

*Assistant Examiner*—Morris H. Nimmo

*Attorney, Agent, or Firm*—Fitch, Even, Tabin & Flannery

[57] ABSTRACT

An electrical cable includes a core, a jacket and improved shielding with unexpectably low transfer impedance. The shielding includes an inner foil laminate, a braided sleeve, and an outer foil laminate, each foil laminate having at least one conductive layer and at least one strength-giving non-conductive layer. At least one of the foils includes a shorting fold to limit the slot effect. Preferably, the inner foil has two conductive layers, and the outer foil has the shorting fold.

15 Claims, 3 Drawing Figures

MULTIPLY SHIELDED COAXIAL CABLE WITH VERY LOW TRANSFER IMPEDANCE

BACKGROUND OF THE INVENTION

The present invention relates to electrical cables, and more particularly to multiply shielded coaxial cables with very low transfer impedance.

Many electrical cables include shielding to reduce signal loss and intercircuit interference. The importance of such shielding is particularly evident in connection with the transmission of large amounts of information in high-frequency bands as in television applications.

Cable shielding serves both ingressive and egressive functions. Limiting the ingress of radio frequency interference (RFI) reduces the distortion and spurious signals that may be induced by electromagnetic fields originating in the cable environment. Limiting the egress of radio frequency (RF) energy limits energy loss from the signals and the contribution of the cable to RFI afflicting neighboring circuits.

Cable shielding usually comprises metal foils, metal braids or both. The foils or braids provide conductive barriers between the cable core and the cable environment while permitting cable flexing. Gaps in the conductive barrier significantly diminish the effectiveness of the shielding. Therefore, braids, which inherently have gaps, often are combined with foils to reduce the gaps and improve effectiveness of the shielding, the braids being used because of their strength and flexibility permitting repeated flexing without rupture.

Simple metal foils thin enough to allow substantial cable flexing often fail structurally. The predominant mode of failure is transverse, a failure known as tiger striping. Many foils are therefore manufactured as a laminate with a strength-giving member, usually of polyester or polypropylene. The strength-giving member helps to maintain the structural integrity of the foil, but prevents the conductive surface from contacting itself where the shield overlaps itself when wrapped around a cable core. Since the strength-giving member is usually nonconductive, a nonconductive gap or slot remains through the shield, permitting the transmission of RF energy therethrough. This leakage can be reduced by providing metal layers on both sides of the strength-giving member, so that there is metal-to-metal contact in the region of overlap. However, as neither metal layer contacts itself, the slot effect is still present.

The combination of braid and foil is well known to be advantageous because of their complementary advantages. See, for example, Wilkenloh U.S. Pat. No. 4,117,260. In addition to the structural strength advantage obtained by the use of braid, braid is well known for low DC resistance, whereas foil reduces gaps in the shielding. The standard combination has been a foil laminate surrounded by a braided metallic layer. For greater shielding effectiveness, it has been known for some time to go beyond the simple combination of a foil with a braid. The next step was to add another layer of foil outside the braid. A standard of the industry is a cable known as type 9110 as manufactured and sold by Belden Corporation, a subsidiary of Cooper Industries, Inc., the assignee of the present application. The Belden 9110 cable has a double foil laminate inner foil surrounded by a metallic braided layer, in turn surrounded by a double foil laminate.

When it became important to provide even more effective shielding, the obvious next step was to add another braided layer, following the well known practice of using the advantages of a braided layer for more effective shielding. Just such a cable has been made and sold by the Times Wire & Cable Company as Times MI-2245 cable. Such cable employs a foil-braid-foil-braid shield that, as expected, has superior shielding effectiveness, as measured by transfer impedance, as compared to prior shields, including the foil-braid-foil shield of Belden 9110 cable.

Transfer impedance as a measure of shielding effectiveness is explained in Kenneth L. Smith, "RF Leakage Test for CATV Drop Cable Gives Absolute Results," *TV Communications,* Dec. 1, 1978, pp. 114–116. The Smith article explains how transfer impedance may be measured and sets forth the transfer impedance characteristic of the Times 2245 cable.

Although Times 2245 cable has been effective and provided an improved transfer characteristic, it has a number of shortcomings. It is not easy to manufacture. It uses much more metal than the Belden 9110 cable. It is expensive. It is bulky. It is the additional layer of braid that makes the cable more costly and bulky, and most significantly of all makes the cable incompatible with standard cable fittings. Certain fittings have become standard for terminating television cables for coupling the cables to one another and to various pieces of television apparatus. It is a nuisance and an expense to have to use special fittings for the Times 2245 cable. There has, therefore, been a need for a cable that provides shielding as effective as the Times 2245 cable that is compatible with standard fittings.

In accordance with the present invention, the solution is to do away with the outer braid and to put what is known as a shorting fold in one of the foil layers, specifically the outer one. A shorting fold is a fold made in the foil laminate so that when the laminate is wrapped around a cable core, a metal layer touches itself at the edges so as to close the slot otherwise formed by the strength member of the laminate. Such shorting folds per se have been known in shielded cables for some time and have been known to be effective at higher frequencies. Conventional wisdom, however, taught that a braided layer was more effective for providing low transfer impedance at lower frequencies and suggested the addition of alternating layers of braid and foil for providing lower transfer impedance, i.e., the Times 2245 cable. At the time applicants made their invention, there was no information as to the actual transfer impedance of a foil-braid-shorting fold foil combination, nor was there any theoretical basis for determining what its transfer impedance might be. There was no way of knowing in advance that the use of the shorting fold would provide a transfer impedance lower than that of the foil-braid foil-braid combination of the Times 2245 cable. Indeed, when applicants first tested their invention, it was to determine how much less effective it would be in respect to achieving low transfer impedance than the Times 2245 cable and whether its lesser effectiveness would not be so bad as not to be offset by the compatibility of the cable with standard fittings. Surprisingly, the new shielding combination proved to be even more effective than the shielding of the Times 2245 cable, as determined by their respective transfer impedance characteristics.

Thus, it is an important aspect of the present invention to provide a cable with improved shielding which is adapted for use with standard connections. In particular, it is an aspect of the present invention to provide a cable with lower transfer impedance and less bulk than the aforementioned Times 2245 cable.

SUMMARY OF THE PRESENT INVENTION

In accordance with the present invention, a cable includes foil-braid-foil shielding with unexpectedly low transfer impedance. At least one of the foil members includes a shorting fold.

The cable comprises a core having a central conductor and a dielectric sheath, foil-braid-foil shielding, and an outer jacket. In a preferred embodiment, the inner foil component of the shielding, bonded to the core, is a double foil laminate structure formed by a strength-giving layer laminated between two metallic layers. A metallic braid is applied over the laminate. An outer foil laminate including a strength-giving layer with a conducting layer laminated thereto is applied over the braid. The outer foil laminate includes a shorting fold. Surprisingly, the transfer impedance of this construction is significantly lower than that of the Times 2254 cable.

Other aspects and advantages of the present invention will become apparent from the following detailed description, particularly when taken with the accompanying drawings.

DETAILED DESCRIPTION

Figure 1:
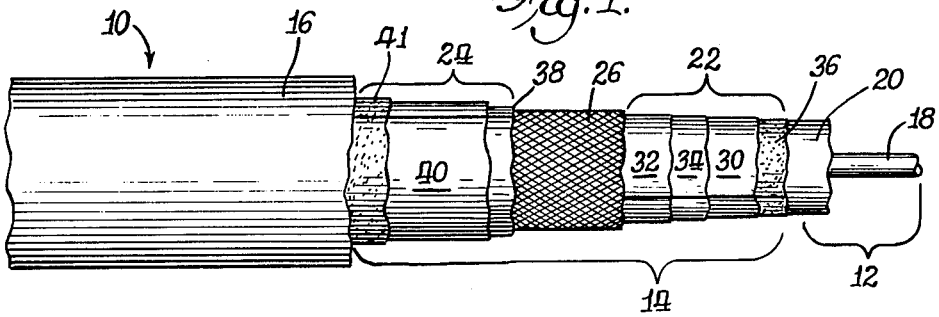
FIG. 1 is a plan view of a cable in accordance with the present invention with certain layers successively broken away.

The cable 10 of the present invention includes a core 12, shielding 14 and an outer jacket 16. The core 12 includes a central conductor 18 embedded in a dielectric sheath 20. The outer jacket 16 protects the core 12 and shielding 14 from moisture and other environmental factors. The outer jacket 16 also provides integrity to the remainder of the cable.

The shielding 14 is designed to minimize transfer impedance without adding unduly to the bulk of the cable 10 and without requiring nonstandard connectors. The shielding 14 includes an inner foil laminate 22, an outer foil laminate 24 and a braided sleeve 26 therebetween. At least one of the foil laminates has a shorting fold 28 whereby an unexpectably low transfer impedance results.

Prior to the present invention, it was believed that adding a braid to foil-braid-foil shielding would be an optimal approach to lowering transfer impedance of a cable design, despite the aforementioned disadvantages in bulk and in nonstandardization of connectors.

The cable of the present invention was constructed particularly for applications where added bulk and nonstandard connectors could not be readily tolerated. Transfer impedance tests were conducted with a view of determining the extent to which the foil-braid-foil with fold shielding was inferior to the foil-braid-foil-braid construction of the Times 2245 cable. Contrary to expectations, the tests performed demonstrated that the cable of the present invention had a significantly lower transfer impedance than that of the Times 2245 cable. In fact, at frequencies between 100 MHz and 400 MHz, the cable of the present invention exhibited a transfer impedance nearly an order of magnitude lower than that of the Times 2245 cable.

Figure 3:
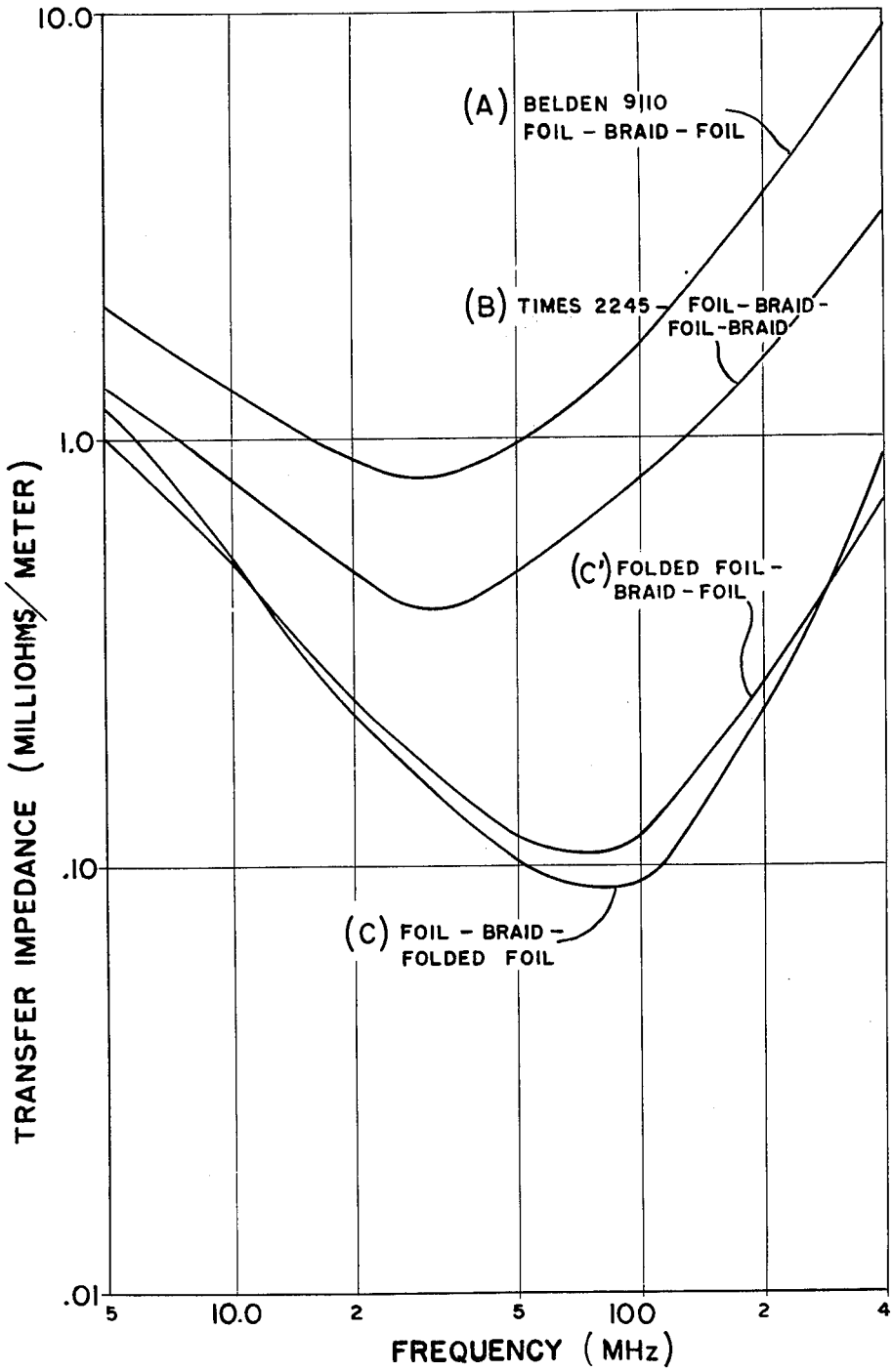
FIG. 3 is a graph depicting the transfer impedances of two prior art cables and a cable in accordance with the present invention over a given frequency range of interest.

The results of comparative tests performed on Belden 9110 foil-braid-foil cable, Times 2245 foil-braid-foil-braid cable, and a foil-braid-foil with fold cable in accordance with the present invention are depicted in FIG. 3, where curves A, B, and C show their respective transfer impedance characteristics over a frequency range between about 5 MHz and 400 MHz. As anticipated, the Times 2245 cable exhibits a lower transfer impedance than Belden 9110 cable over the entire 5 MHz to 400 MHz frequency range. It was expected that the transfer impedance characteristic corresponding to the cable of the present invention would lie somewhere between those of Belden 9110 cable and the Times 2245 cable, at least over a substantial portion of the frequency range. As shown in FIG. 3, however, the cable of the present invention performed far better than either cable, even at lower frequencies.

Figure 2:
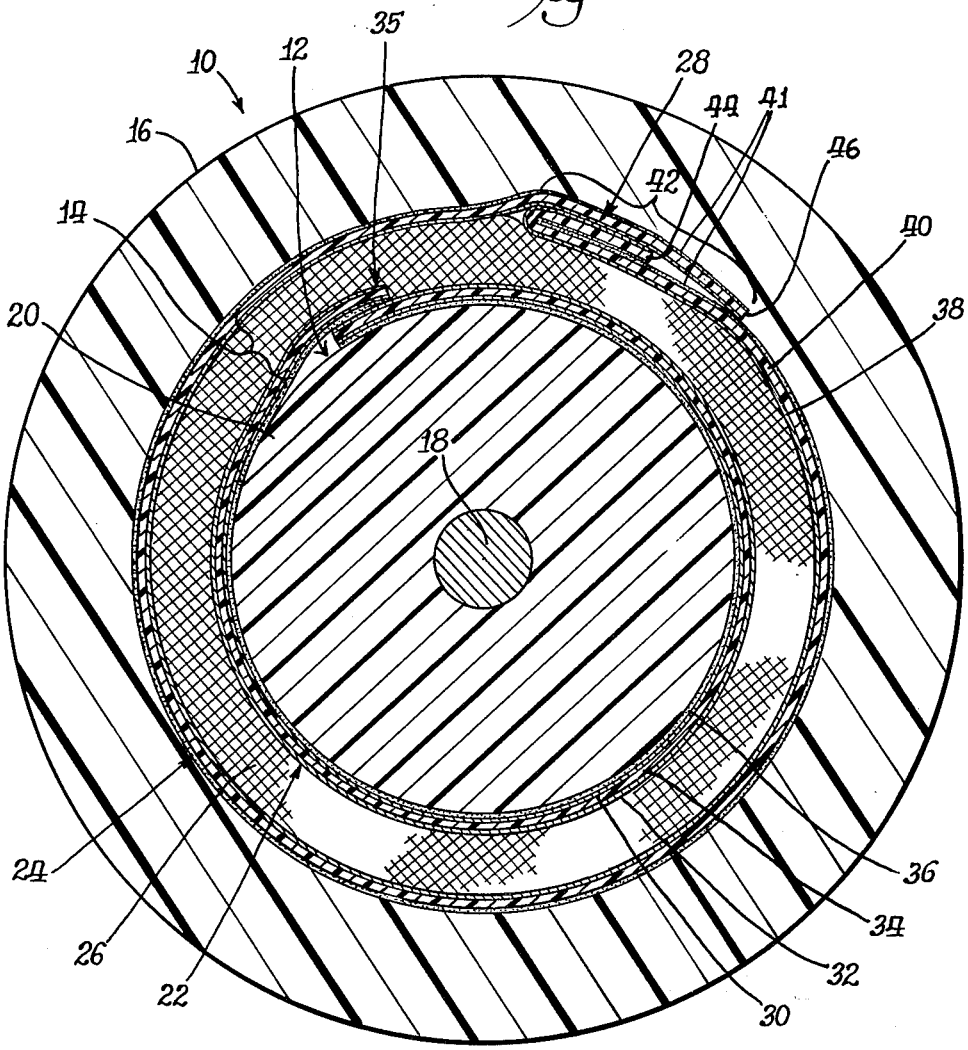
FIG. 2 is a transverse sectional view of the cable shown in FIG. 1.

A preferred embodiment of the cable 10 of the present invention, as tested, may be described in greater detail with reference to FIGS. 1 and 2. The cable is 0.242" in diameter. The central conductor 18 is of 20 AWG copper covered steel wire with a diameter of 0.032". The dielectric sheath 20 is formed of polyethylene. The core 12, including the central conductor 18, is 0.143" in diameter. The shielding 14 contributes about 0.032" to the cable diameter, and the cable jacket 16 contributes the rest.

The inner foil laminate 22 is an aluminum/polypropylene/aluminum laminate. Each aluminum layer 30, 32 is about 0.0035" thick and is conductive; the polypropylene strength-giving layer 34 is about 0.001" thick and is non-conductive. The inner foil laminate 22 is wrapped about the core 12 so as to overlap itself. The inner foil laminate 22 includes a layer 36 of adhesive about 0.001" thick bonding the inner foil to the sheath 20 of the core 12. In the region 35 of overlap, the inner metal layer 30 overlies the outer metal layer 32 with the adhesive layer 36 therebetween.

The braided sleeve 26 is formed from 34 gauge wire, preferably aluminum, which has a diameter of about 0.0063". The overlapping of the braid wire provides a thickness for the sleeve of about 0.0126". In addition to its shielding function, the braided sleeve 26 helps maintain the integrity of the inner foil laminate 22 and holds it snugly to the core 12.

The outer foil laminate 24 is a polyester/aluminum laminate, each layer 38, 40 being about 0.001" thick. The polyester is preferably in the form of film sold by DuPont under the trademark Mylar. The outer foil laminate 24 is wrapped so that the aluminum conductive layer 38 is radially inward of the strength-giving non-conductive layer 40. An adhesive layer 41 about 0.001" thick is applied to the strength-giving layer 40. The outer foil laminate 24 overlaps itself in a region of overlap 42. In the region of overlap, an underlying end 44 is folded back over itself so that the conductive layer 38 of the underlying end 44 physically and electrically contacts the conductive layer 38 of the overlying end 46. This contact or shorting fold 28 closes a potential slot in the region of overlap 42.

The outer jacket 16 is formed of PVC extruded over the outer foil laminate and is bonded thereto by the adhesive layer 41.

In accordance with the present invention, a cable is presented with surprisingly low transfer impedance. Other designs, in addition to the specific embodiment described above, may take advantage of this discovery. For example, a modified cable could have the same elements as the preferred cable, but with the three layer foil radially outward of the braided sleeve, and the folded two layer foil radially inward. The transfer impedance characteristic of the modified cable is shown as curve C' in FIG. 3. The embodiment with the fold on the outer foil is preferred because it allows more ready termination with a standard connector. Other dimensions and arrangements of the elements of the invention are possible. These and other embodiments are within the spirit and scope of the present invention.

What is claimed is:

1. A multiply shielded coaxial cable comprising:

a core having a central conductor and dielectric material surrounding said conductor;

shielding surrounding said core, said shielding comprising an inner foil laminate, a braided sleeve, and an outer foil laminate in radially outward succession, respectively, said braided sleeve being of conductive material, each of said foil laminates including at least one conductive layer and one non-conductive layer, each of said foil laminates being wrapped so as to define a respective region of overlap, at least one of said foil laminates being folded back upon itself so that at least one conductive layer electrically and physically contacts itself in the respective region of overlap, said outer foil laminate being outward of all braided material of said shielding; and a protective jacket surrounding said shielding.

2. A multiply shielded coaxial cable according to claim 1 further characterized in that said foil laminate folded back upon itself is the outer foil laminate.

3. A multiply shielded coaxial cable according to claim 2 further characterized in that said inner foil laminate has a strength-giving non-conductive layer and conductive layers on opposing sides of said strength-giving layer, said inner foil laminate being wrapped about said core so as to overlap itself.

4. A multiply shielded coaxial cable according to claim 1 further characterized in that the foil laminate folded back upon itself is the inner foil laminate.

5. A multiply shielded coaxial cable according to claim 4 further characterized in that said outer foil laminate has a strength-giving non-conductive layer and conductive layers on opposing sides of said strength-giving layer, said inner foil laminate being wrapped about said core so as to overlap itself.

6. A multiply shielded coaxial cable according to any one of claims 1 to 5 wherein said inner foil laminate is bonded to said core.

7. A multiply shielded coaxial cable according to any one of claims 1 to 5 wherein said outer foil laminate is bonded to said jacket.

8. A multiply shielded coaxial cable according to any one of claims 1 to 5 wherein said inner foil laminate is bonded to said core and said outer foil laminate is bonded to said jacket.

9. A multiply shielded coaxial cable comprising:

a core having a central conductor and dielectric material surrounding said conductor;

an inner foil laminate having a conductive layer and a non-conducting layer and surrounding said core;

a metal braided sleeve surrounding said inner foil laminate;

an outer foil laminate having a conductive layer, a strength-giving non-conductive layer and two longitudinally extending edges, said outer foil laminate being wrapped about said braided sleeve so that said edges overlap, one of said edges being folded so that the conductive surface of that edge is in physical and electrical contact with the conductive surface of the other of said edges, said outer foil laminate being outward of all braided metal of said cable; and a protective jacket surrounding said outer foil laminate.

10. A multiply shielded coaxial cable according to claim 9 further characterized in that said inner foil laminate has a strength-giving non-conducting layer and conductive layers on opposing sides of said strength-giving layer, said inner foil laminate being wrapped about said core as to overlap itself.

11. A multiply shielded coaxial cable according to claim 9 further characterized in that said conductive layer of said outer foil laminate is disposed radially inward of said strength-giving layer of said outer foil laminate.

12. A multiply shielded coaxial cable according to claim 9 further characterized in that said folded edge underlies the other said edge.

13. A multiply shielded coaxial cable according to any one of claims 9 to 12 wherein said inner foil laminate is bonded to said core.

14. A multiply shielded coaxial cable according to any one of claims 9 to 12 wherein said outer foil laminate is bonded to said jacket.

15. A multiply shielded coaxial cable according to any one of claims 9 to 12 wherein said inner foil laminate is bonded to said core and said outer foil laminate is bonded to said jacket.

* * * * *